US007401764B1

(12) United States Patent
Castillo

(10) Patent No.: US 7,401,764 B1
(45) Date of Patent: Jul. 22, 2008

(54) ELECTRONIC JACK

(76) Inventor: Eliezer R. Castillo, 969 Barbados Ave., Orlando, FL (US) 32825

( * ) Notice: Subject to any disclaimer, the term of this patent is extended or adjusted under 35 U.S.C. 154(b) by 118 days.

(21) Appl. No.: 11/294,201

(22) Filed: Dec. 6, 2005

(51) Int. Cl.
*B66F 3/24* (2006.01)
*B66F 3/18* (2006.01)

(52) U.S. Cl. ..... 254/93 H; 254/103

(58) Field of Classification Search ..... 254/93 H, 254/93 R, 8 B, 103
See application file for complete search history.

(56) References Cited

U.S. PATENT DOCUMENTS 1,514,120 A * 11/1924 Alters ..... 254/103
1,969,408 A * 8/1934 Heinrich et al. ..... 254/93 H
2,284,958 A * 6/1942 Grime ..... 254/93 H
3,622,124 A * 11/1971 Sidles et al. ..... 254/3 R
3,918,683 A * 11/1975 Millar ..... 254/93 R
4,047,698 A * 9/1977 Ellis ..... 254/2 R
4,174,094 A 11/1979 Valdespino et al.
4,598,898 A * 7/1986 Hsu et al. ..... 254/93 H
4,706,937 A * 11/1987 Chung ..... 254/93 H
5,224,688 A 7/1993 Torres et al.
5,465,940 A 11/1995 Guzman et al.
5,722,641 A 3/1998 Martin et al.
6,224,040 B1 5/2001 Mejias et al.
6,722,634 B1 * 4/2004 Hsu ..... 254/8 B
6,877,200 B2 * 4/2005 Villarreal ..... 254/93 H

* cited by examiner

*Primary Examiner*—Hadi Shakeri

(57) ABSTRACT

An electronic jack for lifting heavy objects, such as a portion of a vehicle is described. The electronic jack has an outer casing that houses a motor, a hydraulic system, and a hydraulic lift unit that is activated by the hydraulic system. The motor is preferred to be a twelve volt electric motor and can be electronically connected to a vehicle through a cigarette lighter adapter.

1 Claim, 6 Drawing Sheets

ELECTRONIC JACK

BACKGROUND OF THE INVENTION

The present invention concerns that of a new and improved electronic jack for lifting heavy objects, such as a portion of a vehicle.

DESCRIPTION OF THE PRIOR ART

U.S. Pat. No. 5,224,688 filed by Torres et al., discloses a series of hydraulic jack units which are mounted on the frame of a vehicle.

U.S. Pat. No. 6,224,040 filed by Mejias et al., discloses a vehicle lift system for lifting a corner of a vehicle by remote control.

U.S. Pat. No. 5,722,641 filed by Martin et al., discloses a vehicle mounted tire changing system which comprises a hydraulic jack system connected to a vehicle.

U.S. Pat. No. 4,174,094 filed by Valdespino et al., discloses a leveling and support system for recreational vehicles which operates on a plurality of telescoping air cylinders.

U.S. Pat. No. 5,465,940 filed by Guzman et al., discloses a pneumatic jack system for a motor vehicle comprising a pneumatic jack with a bracket for mounting the pneumatic jack to a suspension assembly of the motor vehicle between two wheels.

SUMMARY OF THE INVENTION

The present invention concerns that of a new and improved electronic jack for lifting heavy objects, such as a portion of a vehicle. The electronic jack has an outer casing that houses a motor, a hydraulic system, and a hydraulic lift unit that is activated by the hydraulic system. The motor is preferred to be a twelve volt electric motor and can be electronically connected to a vehicle through a cigarette lighter adapter.

There has thus been outlined, rather broadly, the more important features of an electronic jack that the detailed description thereof that follows may be better understood and in order that the present contribution to the art may be better appreciated. There are, of course, additional features of the electronic jack that will be described hereinafter and which will form the subject matter of the claims appended hereto.

In this respect, before explaining at least one embodiment of the electronic jack in detail, it is to be understood that the electronic jack is not limited in its application to the details of construction and to the arrangements of the components set forth in the following description or illustrated in the drawings. The electronic jack is capable of other embodiments and being practiced and carried out in various ways.

Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present electronic jack. It is important, therefore, that the claims be regarded as including such equivalent constructions insofar as they do not depart from the spirit and scope of the present invention.

It is therefore an object of the present invention to provide an electronic jack which has all of the advantages of the prior art and none of the disadvantages.

It is another object of the present invention to provide an electronic jack which may be easily and efficiently manufactured and marketed.

It is another object of the present invention to provide an electronic jack which is of durable and reliable construction.

It is yet another object of the present invention to provide an electronic jack which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
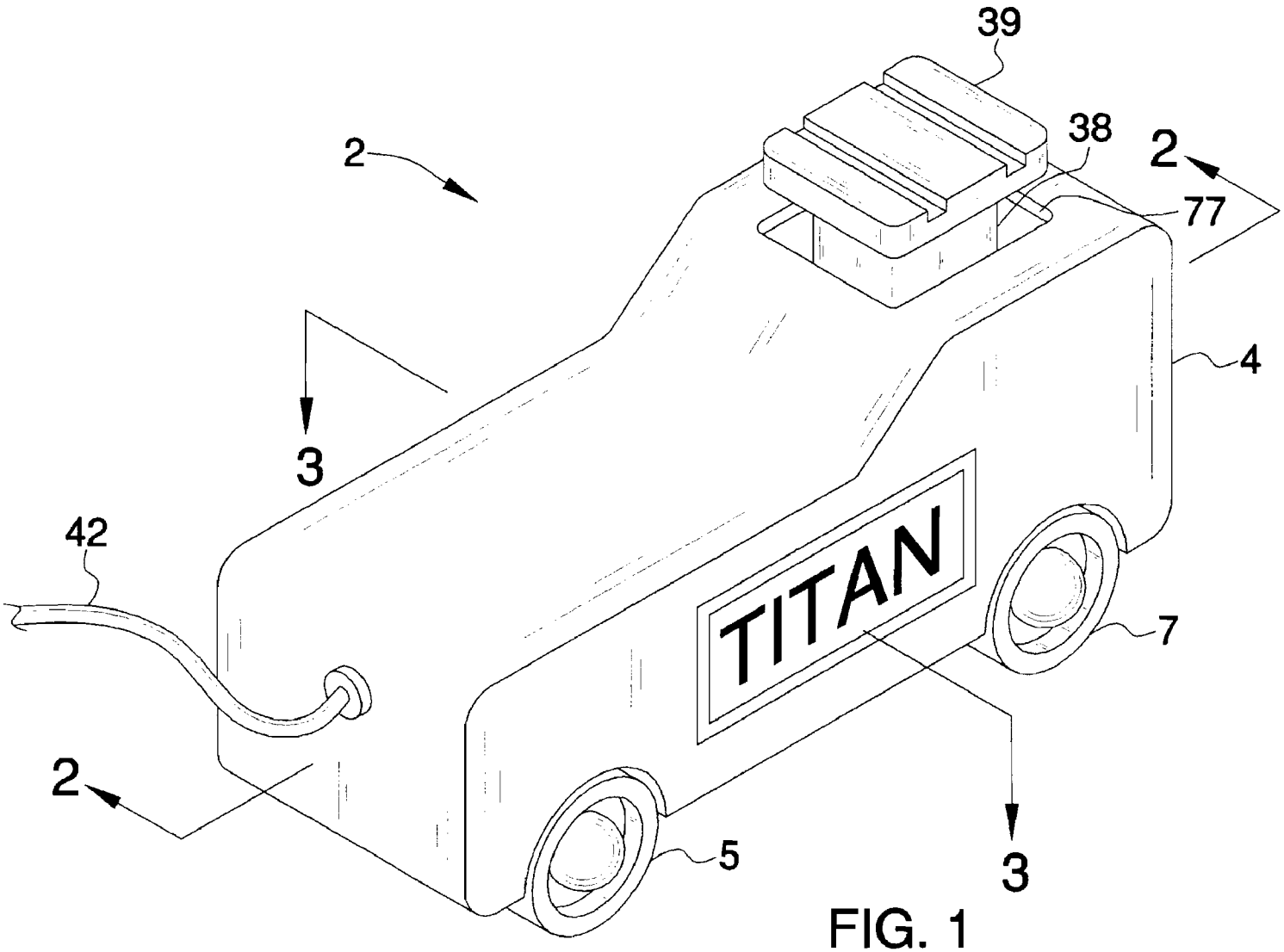
FIG. 1 shows a perspective view of the preferred embodiment of the electronic jack as it would appear in use.
Figure 2:
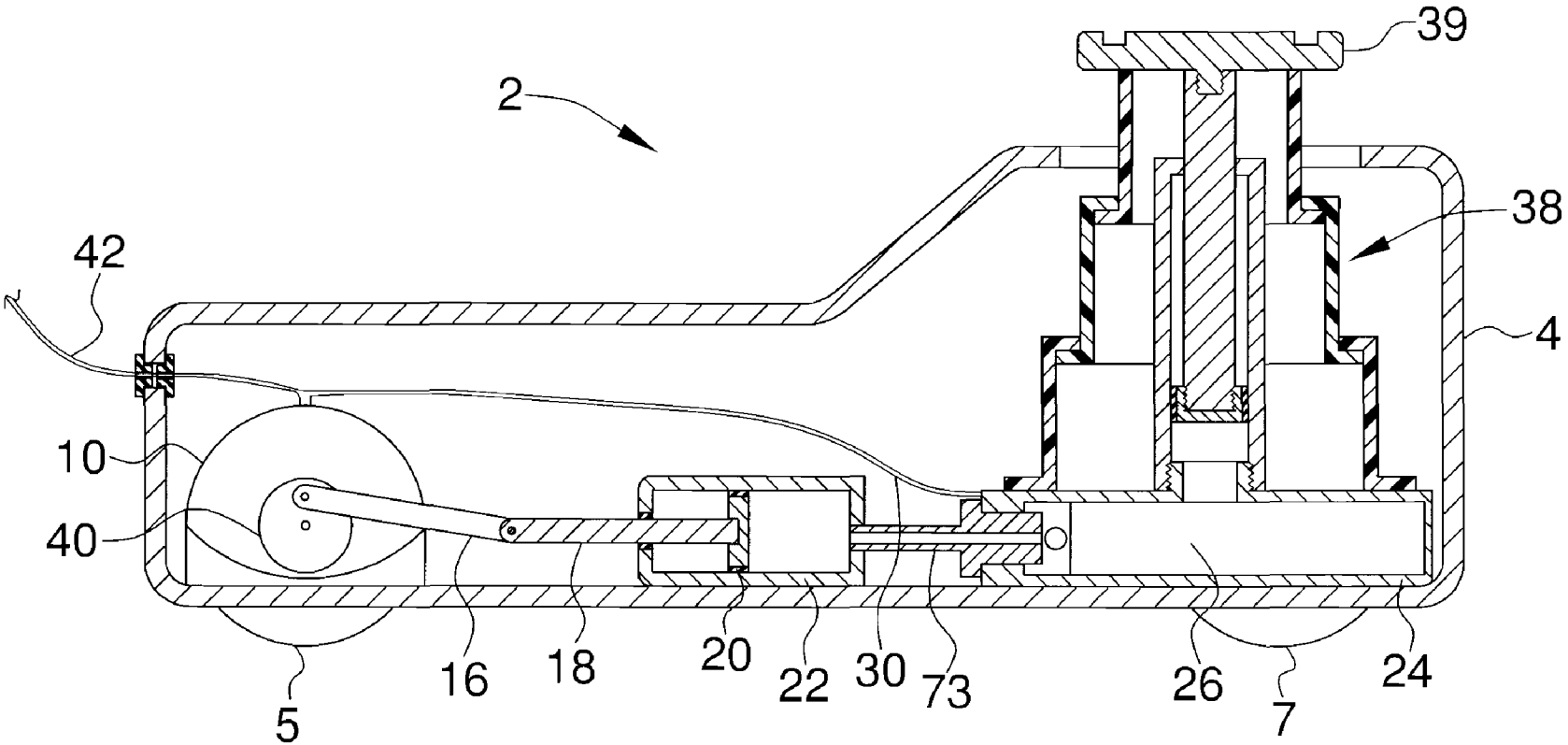
FIG. 2 shows a side cutaway view of the preferred embodiment of the electronic jack as it would appear in use.
Figure 3:
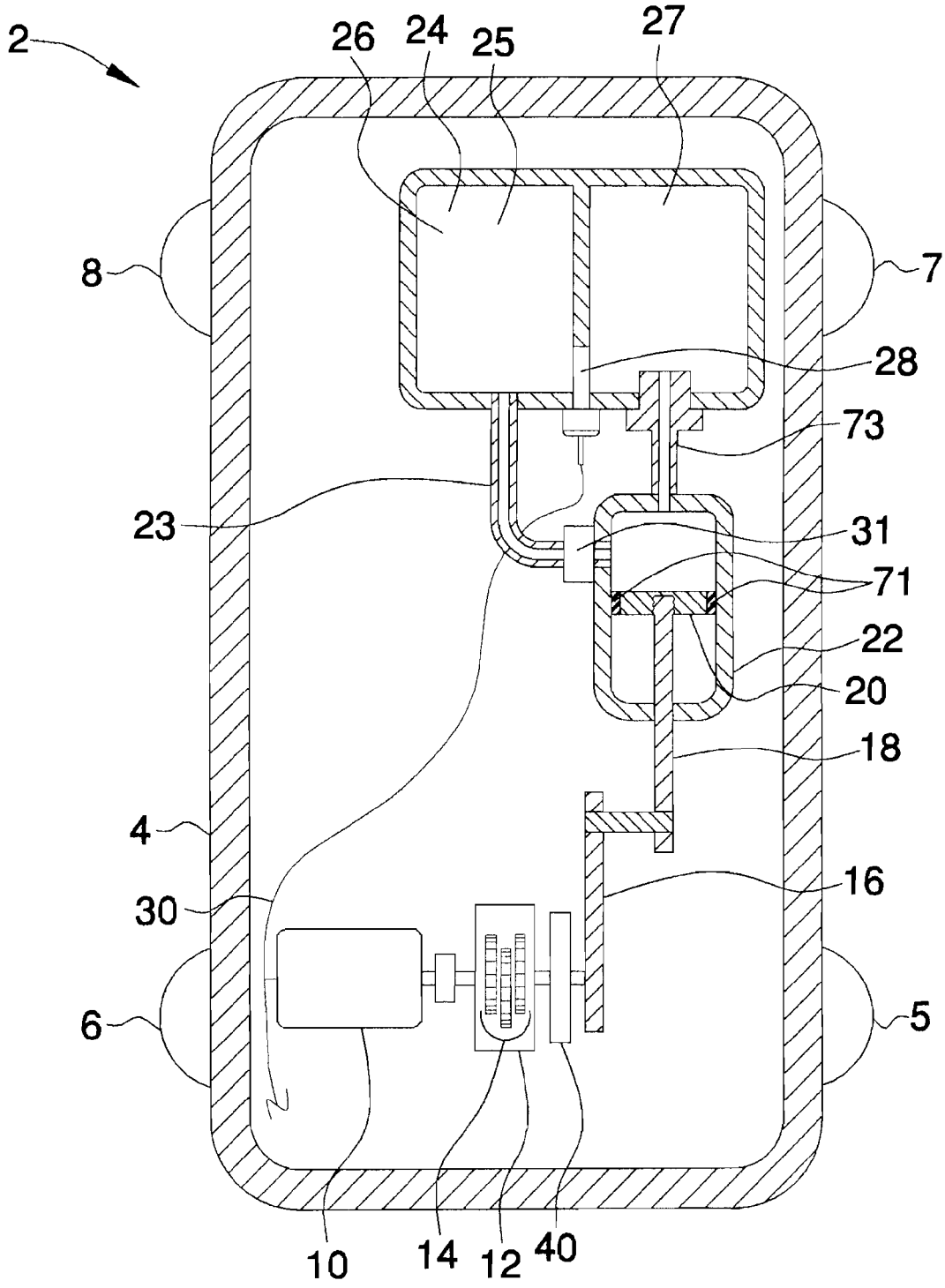
FIG. 3 shows a side cutaway view of the preferred embodiment of the electronic jack as it would appear in use.
Figure 4:
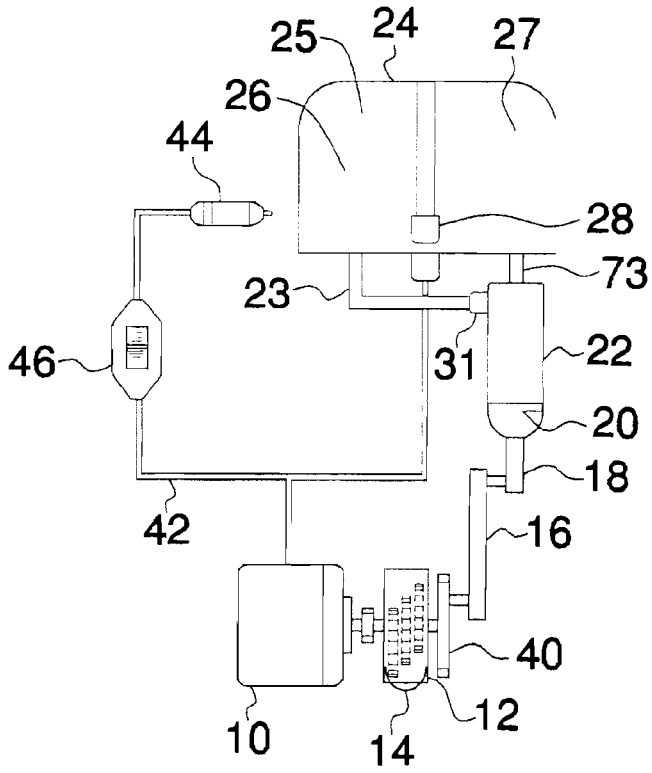
FIG. 4 shows a top view of various working components located within the outer casing of the preferred embodiment of the electronic jack.

FIG. 1 shows a perspective view of the preferred embodiment of the electronic jack 2 as it would appear in use, while FIG. 2 shows a side cutaway view of the preferred embodiment of the electronic jack 2 as it would appear in use. Furthermore, FIG. 3 shows a side cutaway view of the preferred embodiment of the electronic jack 2 as it would appear in use, while FIG. 4 shows a top view of various working components located within the base 4 of the preferred embodiment of the electronic jack 2.

The electronic jack 2 comprises a base 4 with two ends comprising a front end and a rear end. The jack 2 has four wheels comprising a left front wheel 5, a right front wheel 6, a left rear wheel 7, and a right rear wheel 8. The base 4 is rectangularly-shaped.

Base 4 has an internal motor 10 located within the base 4. Motor is preferably an electric motor and is preferably a twelve volt electric motor. Power cord 42 has two ends, a first end and a second end, with the first end of the power cord 42 being attached to the motor 10. The second end of the power cord 42 has a cigarette lighter adapter 44 which allows the jack 2 to draw power from vehicle electronics merely by connecting the adapter 44 into an adapter slot within the vehicle. A control switch 46 is attached to the power cord 42 in between the adapter 44 and the first end of the power cord 42.

Motor 10 is connected to a plurality of reduction gears 14 that are located within a reduction gear unit 12. The reduction gear unit 12 is subsequently coupled to a offsetted shaft 40, which is coupled to a first arm 16. The first arm 16 is coupled to a second arm 18.

Hydraulic pressure container 22 is located within the base 4. Within the hydraulic pressure container 22 is located a piston 20, with the piston 20 being coupled to the second arm 18. The cross-sectional shape of the piston 20 matches almost exactly the cross-sectional shape of the internal dimensions of the hydraulic pressure container 22. Any gaps are filled in by seals 71.

Hydraulic fluid container 24 is located within the base, with the container 24 comprising a volume of hydraulic fluid 26. The fluid container 24 is a two compartment container comprising a first compartment 25 and a second compartment 27. Prior to using the present invention, the fluid 24 is located in both compartments 25 and 27. The compartments 25 and 27 are completely separated from one another except for a pressure relief solenoid valve 28 that is located in between the compartments. Although usually closed, this valve 28 can be opened once the jack 2 is no longer in use, thereby allowing the hydraulic pressure within both compartments 25 and 27 to stabilize. The valve 28 is electronically connected to the motor 10 via at least one wire 30.

A pressure hose 23 is present that has two ends, a first end and a second end. The first end of the pressure hose 23 is connected to the hydraulic fluid container 22 via a one-way valve 31, while the second end of the pressure hose 23 is connected to the first compartment 25. The one-way valve 31 allows hydraulic fluid 26 to travel from the hydraulic pressure container 22 to the first compartment 25, but not vice versa.

A short feeder tube 73 has two ends, a first end and a second end, with the first end of the feeder tube 73 being connected to the second compartment 27 and the second end of the feeder tube 73 being connected to the hydraulic pressure container 22. The feeder tube 73 allows hydraulic fluid 24 to be drawn from the second compartment 27 when the second compartment 27 is in use so that the hydraulic fluid can be pumped into the first compartment 25.

A hydraulic lift unit 38 is also located within the base 4. Hydraulic lift unit 38 is contiguous with the first compartment 25 and is capable of lifting a platform 39 once pressure within the first compartment 25 is raised through operation of the jack 2. The platform 39 pokes through a hole 77 that is located on the base 4, with the platform designed to rise straight up to a needed height.

When the preferred embodiment, as shown in FIGS. 1-4 and 7, is needed for operation, an individual can first connect the cigarette lighter adapter 44 to a vehicle for power and then can activate the control switch 46. Next, the base 4 needs to be mounted under a portion of a vehicle that needs to be lifted up so that the platform 39 is directly under this vehicle portion.

Once the motor 10 commences working, it causes the piston 20 to move back and forth within the hydraulic pressure container. This movement draws hydraulic fluid 24 from the second compartment 27 through the feeder tube 73 and subsequently forces this hydraulic fluid 24 through the one-way valve 31, through the pressure hose 23, and into the first compartment 25. Once the hydraulic pressure within the first compartment 25 is high enough, it will cause the hydraulic lift unit 38 to lift a small distance.

Repeated movings of the piston back and forth will continually build up the pressure in the first compartment 25, causing the hydraulic lift unit 38 to continually push the platform 39 higher and higher. Once the platform 39 has lifted the vehicle portion to a desired height, the motor 10 can be stopped, causing the platform 39 to remain at the particular desired height.

Once the desired work is done on the vehicle, the pressure relief solenoid valve 28 can be activated by the control switch 46. As long as this is done in a careful and controlled manner, the extra pressure within the first compartment 25 will quickly equalize with the pressure in the second compartment 27, causing the hydraulic lift unit 38 to slowly disengaged and the platform 39 to slowly lower down to its default position. Then, the jack 2 could be removed.

Figure 5:
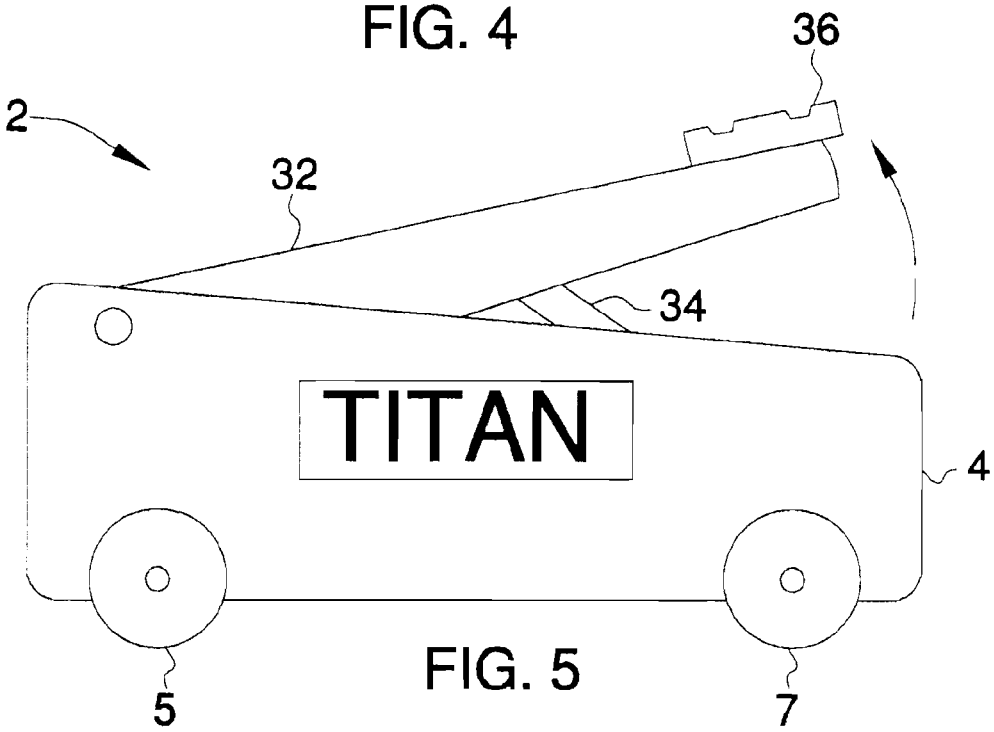
FIG. 5 shows a side view of an alternative embodiment of the electronic jack as it would appear in use.
Figure 6:
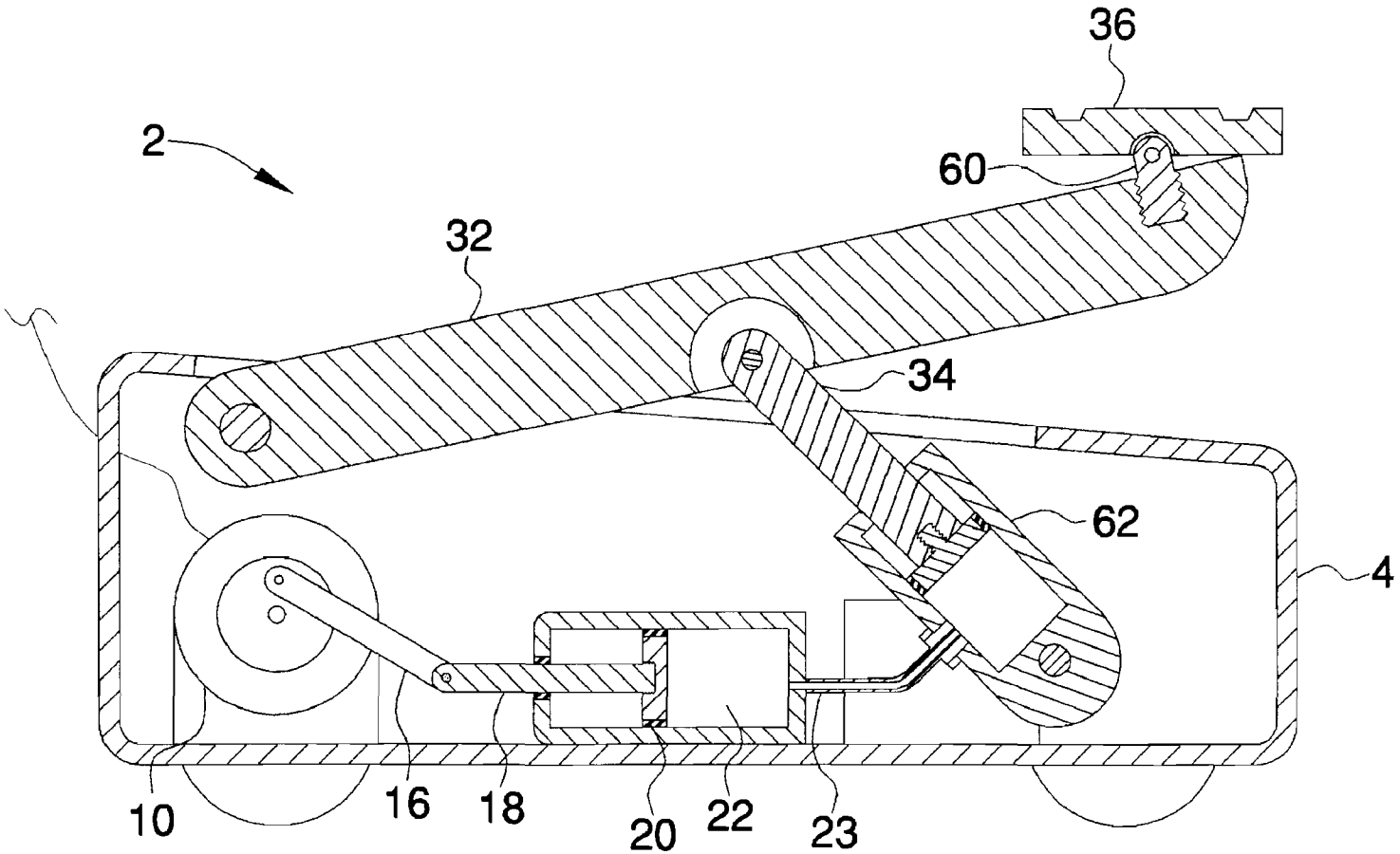
FIG. 6 shows a side cutaway view of the alternative embodiment of the electronic jack as it would appear in use.

FIG. 5 shows a side view of an alternative embodiment of the electronic jack 2 as it would appear in use, while FIG. 6 shows a side cutaway view of the alternative embodiment of the electronic jack 2 as it would appear in use. In this embodiment, the hydraulic lift unit 62 is diagonally positioned instead of vertically positioned, as in the preferred embodiment shown in FIGS. 1-4 and 7.

The hydraulic lift unit 62 in the alternative embodiment of the electronic jack 2 is connected to a primary arm 32, which has two ends, a first end and a second end. The hydraulic lift unit 62 includes a secondary arm 34 which has two ends, a first end and a second end. The second end of the secondary arm 34 is attached to the primary arm 32 about halfway between the first end and the second end of the primary arm 32.

The first end of the primary arm 32 is pivotally attached to the base 4 while the second end of the primary arm 32 has platform 36 pivotally attached to it. Platform 36, although pivotally attached, can move only a little bit, perhaps five to ten degrees, to accommodate various small movements. As the hydraulic life unit 62 in the alternative embodiment of the electronic jack 2 pushes higher and higher, the primary arm 32 is pushed upward diagonally.

Figure 7A:
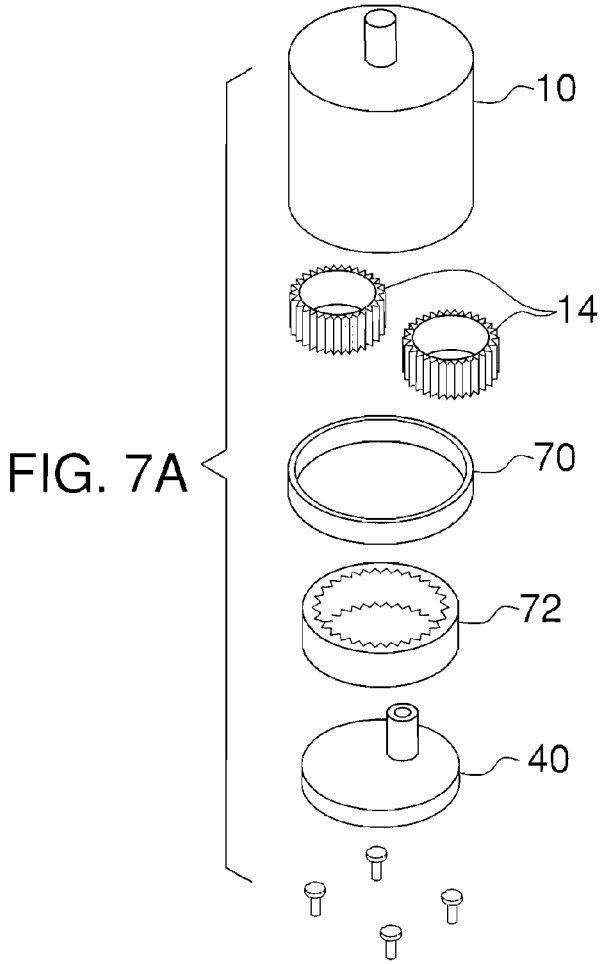
FIG. 7A shows a perspective view of various components utilized with the preferred embodiment of the electronic jack.
Figure 7B:
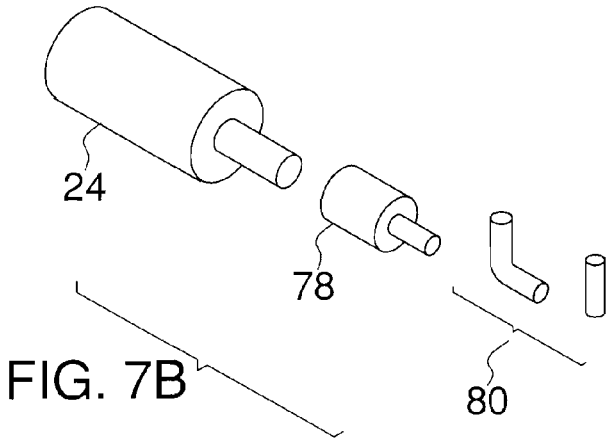
FIG. 7B shows a perspective view of the hydraulic pump and its associated components that are associated with the electronic jack.
Figure 7C:
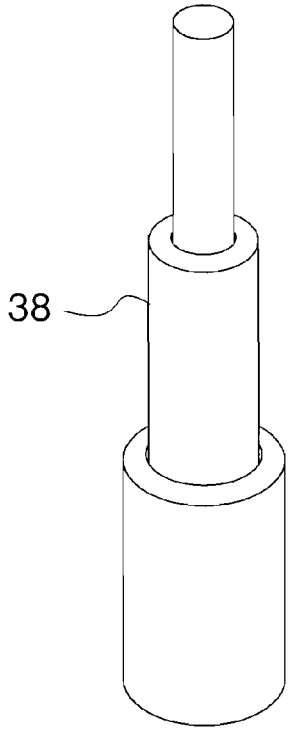
FIG. 7C shows a perspective view of the hydraulic car jack actuator.

FIG. 7 shows a perspective view of various components utilized with the preferred embodiment of the electronic jack. Of special note are a representation of a planetary gear 72 and a planetary gear support 70, which are utilized in conjunction with the plurality of reduction gears 14. Furthermore, the hydraulic fluid container 24 is shown in conjunction with an electric check valve 78 and some hydraulic lines 80, which are meant to be representative of the various hydraulic lines used with the present invention. Finally, the hydraulic lift unit 38 is shown as it would appear in an extended position.

I claim:

1. An electronic jack comprising:

a rectangularly shaped base comprising a front end and a rear end;

the base further having four wheels comprising a left front wheel, a right front wheel, a left rear wheel, and a right rear wheel;

an internal electric motor located within the base;

a power cord having two ends, a first end and a second end, with the first end of the power cord being attached to the motor, the second end of the power cord having a cigarette lighter adapter, wherein the adaptor allows the jack to draw power from a vehicle electronics by connecting the adapter into an adapter slot within the vehicle;

a control switch attached to the power cord in between the adapter and the first end of the power cord;

a reduction gear unit;

wherein the motor is connected to a plurality of reduction gears that are located within the gear reduction unit;

the reduction gear unit is further coupled to an offset shaft;

the offset shaft is coupled to a first arm, the first arm is coupled to a second arm a hydraulic pressure container is located within the base, the pressure container further comprises a piston, the piston being coupled to the second arm;

a two compartment hydraulic fluid container is located within the base, the fluid container having a first and second compartments;

wherein the first and second compartments define two compartments of equal volume and, further, the compartments are positioned side by side within the hydraulic fluid container;

an electronic pressure relief solenoid valve located in between the compartments the valve further electronically connected to the motor;

a pressure hose having two ends, a first end and a second end wherein the first end of the pressure hose is connected to the hydraulic pressure container via a one-way valve, while the second end of the pressure hose is connected to the first compartment of the fluid container;

a short feeder tube having two ends, a first end and a second end, with the first end of the feeder tube connected to the second compartment of the fluid container and the second end of the feeder tube connected to the hydraulic pressure container;

a hydraulic lift unit is located within the base;

wherein the hydraulic lift unit is contiguous with the first compartment of the fluid container.

* * * * *